United States Patent [19]

Shimamoto et al.

[11] 4,384,265

[45] May 17, 1983

[54] SUPERCONDUCTIVE COIL

[75] Inventors: Susumu Shimamoto; Toshinari Ando; Hiroshi Tsuji, all of Ibaraki; Takashi Sato; Yasuhide Hattutori, both of Kobe, all of Japan

[73] Assignees: Mitsubishi Denki Kabushiki Kaisha; Japan Atomic Energy Research Institute, both of Tokyo, Japan

[21] Appl. No.: 287,819

[22] Filed: Jul. 28, 1981

[30] Foreign Application Priority Data

Aug. 5, 1980 [JP] Japan ..... 55-107398

[51] Int. Cl.[3] ..... H01F 7/22

[52] U.S. Cl. ..... 335/216; 174/126 S

[58] Field of Search ..... 335/216; 174/126 S, 174/128 S

[56] References Cited

U.S. PATENT DOCUMENTS

| | | | |
|---|---|---|---|
| 3,514,730 | 5/1970 | Kassner | 335/216 |
| 3,869,686 | 3/1975 | Benz | 335/216 |
| 3,913,044 | 10/1975 | Albrecht et al. | 335/216 |
| 3,919,677 | 11/1975 | Young et al. | 335/216 |
| 4,101,731 | 7/1978 | Marancik . | |

*Primary Examiner*—George Harris

*Attorney, Agent, or Firm*—Oblon, Fisher, Spivak, McClelland & Maier

[57] ABSTRACT

A superconductive coil includes a plurality of pancake coils made of superconductive wires which each have cooling surface and on each of which first and second fine grooves are respectively formed in different directions wherein the first fine grooves are formed in a step of preparing the superconductive wires and the second fine channels are formed on the pancake coils which is constructed by winding said superconductive wires having the first fine grooves in the form of a pancake.

3 Claims, 14 Drawing Figures

PRIOR ART

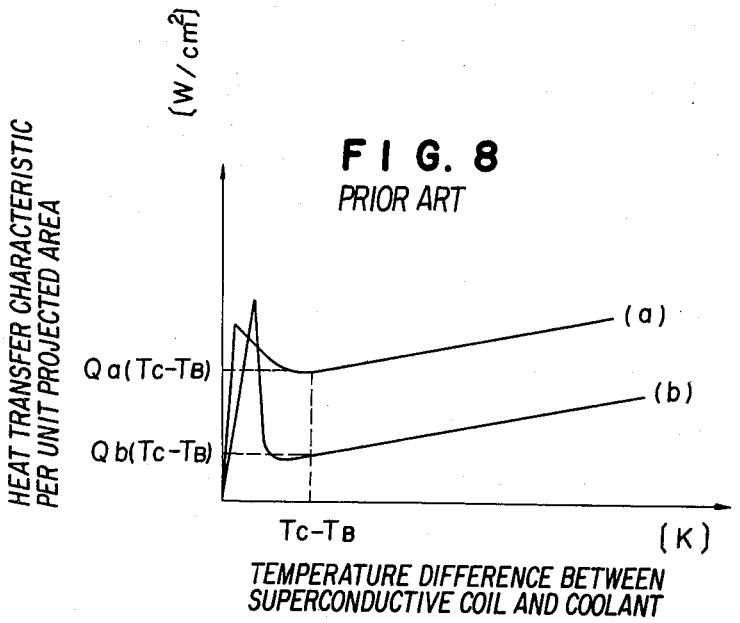
FIG. 8
PRIOR ART
FIG. 9
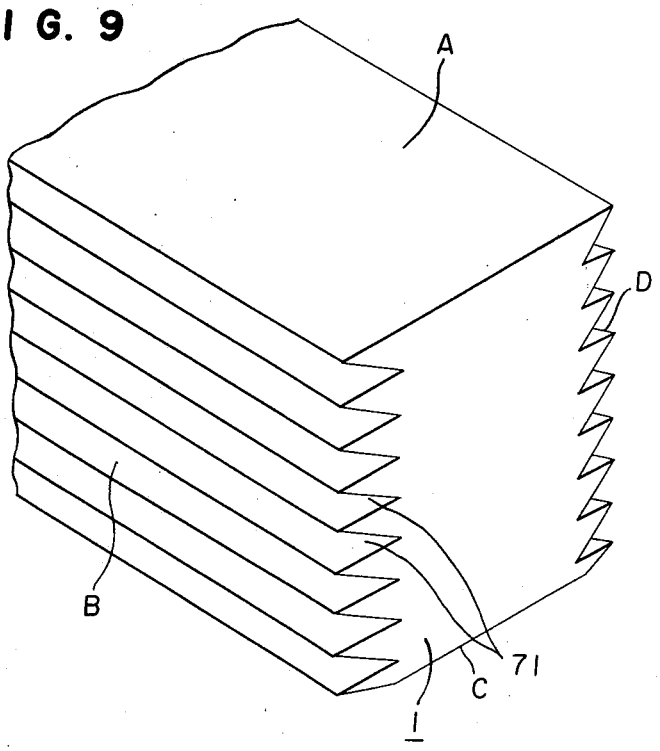

FIG. 10
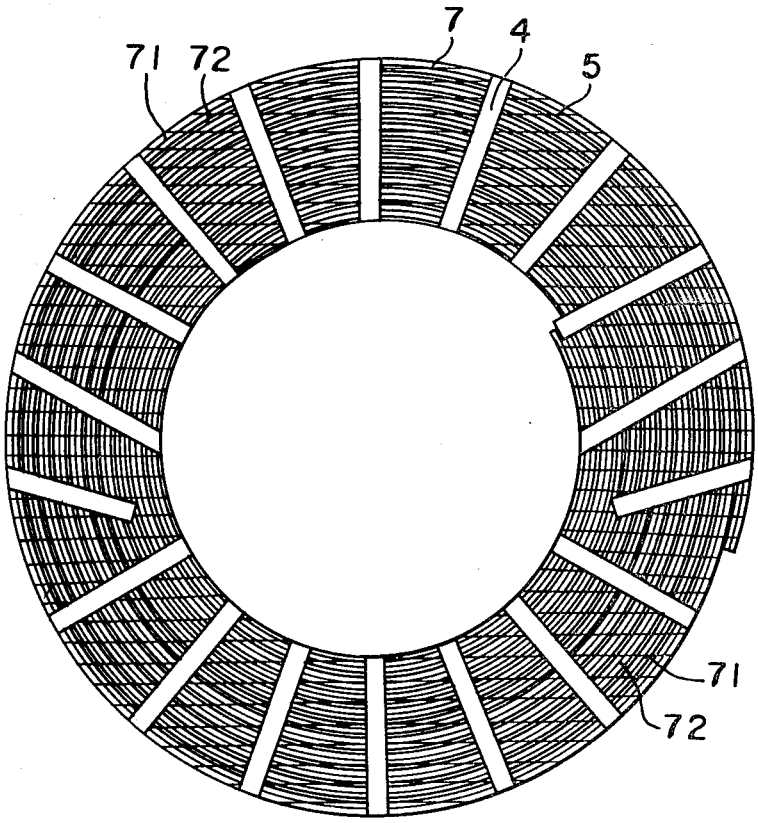
FIG.11(a)
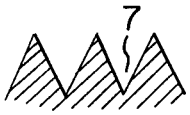
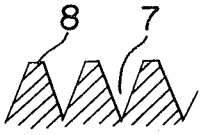
FIG. 11(b)
FIG.11(c)
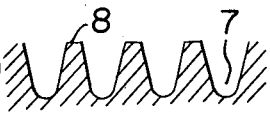
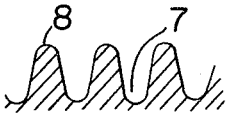
FIG. 11(d)

SUPERCONDUCTIVE COIL

BACKGROUND OF THE INVENTION

1. Field of the Invention

The present invention relates to a superconductive coil. More particularly, it relates to an improvement of the cooling effect of a superconductive coil.

2. Description of the Prior Art

FIG. 1 is a conventional schematic view of a superconductive coil. In FIG. 1, reference (1) designates a superconductive wire; (2) designates a pancake coil prepared by winding the superconductive wire (1); and (3) designates a cooling channel between the pancake coils (2). The superconductive coil is cooled by a coolant (usually liquid helium). The coolant is fed into the cooling channels (3) to cool the superconductive wire (1).

FIG. 2 is a schematic view of two plates of the pancake coils (2) of the superconductive coil of FIG. 1. Reference (4) is a spacer for forming the cooling channels (3). The cooling channels (3) a width of which is substantially equal to a thickness of the spacer (4) are formed between the pancake coils (2) and the coolant is fed into the cooling channels.

FIG. 3 is a sectional view taken along the line A—A of FIG. 2.

FIG. 4 is an enlarged view of the part of the superconductive wire (1) shown in FIG. 3. Reference (5) is an insulator between turns of the superconductive wires (1). As it is clear from the drawings, the parts of the superconductive wires (1) cooled by the coolant are both side surfaces of the superconductive wires (1). The upper and lower surfaces of the superconductive wires (1) are covered by the insulator (5) between the turns and can not be directly cooled by the coolant.

In the above-mentioned description, it is illustrated that the parts of the superconductive wires (1) cooled by the coolant are both side surfaces of the superconductive wire (1).

The relation of the cooling of the superconductive wire (1) and the current fed to the superconductive wire (1) will be described. Usually, the current fed to the superconductive wires (1) of the large size superconductive coil is decided depending upon the following criterion (full stabilization). Even though the superconductivity of the superconductive wire (1) is broken by certain instantaneous disturbance to result in a resistance of the superconductive wire (1) (normal conductive state), the Joule's heat caused by the superconductive wires (1) is eliminated by the coolant after the elimination of the disturbance. The temperature of the superconductive wire (1) is reduced to less than the critical temperature $T_C$ of the superconductive wires (1) whereby the superconductive characteristics are recovered in the complete stabilization criterion which is shown by the equation:

$$RI^2 \leqq Q(T_C - T_B)S \quad (1)$$

wherein the reference R designates a resistance of the superconductive wire (1) per unit length in the normal conductive state; I desigates a current fed through the superconductive wires (1); Q(T) designates a heat flux eliminated from the superconductive wires (1) by the coolant; $T_C$ designates a critical temperature of the superconductive wire (1); and S designated a projected area per unit length.

Equation (1) can be changed to equation (2):

$$I \lesssim \sqrt{\frac{Q(T_C - T_B)S}{R}} \quad (2)$$

The current of the superconductive coil increases depending upon an increase of $Q(T_C - T_B)$ as clearly understood by the equation (2). That is, the current density of the superconductive wires (1) increases. This equation means that an increase occurs in a magnetic field formed by the superconductive coil or also means that it is possible to decrease the length of the superconductive wires (1) at a constant resulting magnetic field. From this viewpoint, it is quite important to increase a heat flux $Q(T_C - T_B)$ eliminated from the superconductive wires (1) by the coolant.

FIG. 5 is an enlarged schematic view of the conventional superconductive wire and B and C designate cooling surfaces.

FIG. 6 is a plane view of a conventional pancake coil (2) winding the superconductive wires (1).

The conventional superconductive coil is formed by plying a plurality of the conventional pancake coils. The cooling surfaces of the conventional superconductive pancake coils are smooth surfaces shown by the references B and D in FIG. 5. The heat flux $Q(T_C - T_B)$ per unit area can not read higher than a constant value.

Therefore, a method of increasing the heat flux $Q(T_C - T_B)$ per unit area by forming many fine grooves (7) which cross in two directions, on the cooling surfaces of the superconductive wires (1) has been proposed as a prior art.

FIG. 7 is an enlarged schematic view of the superconductive wires (1) in the prior art proposed. Many fine grooves having a V shaped sectional view which are mutually crossed are formed on parts of the B and D planes as the cooling surfaces of the superconductive wires (1).

FIG. 8 is a characteristic diagram for comparing the heat transfer characteristic ($W/cm^2$) per unit projected area of the B (or D) surface on which the fine grooves are formed as shown in FIG. 7 and the heat transfer characteristic of the B (or D) surface which is as smooth as the conventional coil as shown in FIG. 5. In FIG. 8, the heat transfer characteristic on the fine grooves forming surface is shown by the curve (a) and the heat transfer characteristic on the smooth surface is shown by the curve (b). As it is clearly understood, $Q_a(T_C - T_B)$ is about 2.5 times by $Q_b(T_C - T_B)$. The superconductive wires (1) proposed can pass a current of about $\sqrt{2.5}$ ($\simeq 1.6$) times that of the conventional superconductive wires (1) as shown by the equation (2). The high magnetic field and high current density of the superconductive coil are attained and a compact superconductive coil can be obtained.

The excellent heat transfer characteristic as $Q_a(T_C - T_b)$ shown in FIG. 8 is not always provided by forming the fine grooves in two directions as the B or D surface of FIG. 7. It is therefore necessary to recognize the following condition. That is, the pitch of the fine grooves (7) is 1.5 mm or less in each direction and the depth of the fine grooves (7) is the same or more of the pitch of the fine grooves (7). The superconductive wire having excellent cooling characteristic and a large current capacity can be obtained by forming the fine grooves (7) as shown in the proposed prior art. However, it is a difficult process to form fine grooves in two directions and especially to form crossed fine grooves as shown in the proposed prior art by a cutting or knurling process in the preparation of the superconductive wires though fine grooves in parallel to the superconductive wire can be easily formed.

SUMMARY OF THE INVENTION

It is an object of the present invention to overcome the disadvantages of the conventional and proposed prior art.

It is another object of the present invention to provide a superconductive coil which is easily prepared and has excellent characteristics.

The foregoing and other objects of the present invention have been attained by providing a superconductive coil which comprises a pancake coil made of superconductive wires having a cooling surface on which first and second fine grooves are respectively formed in different directions, wherein said first fine grooves are formed in a step of preparing said superconductive wires and said second fine channels are formed on said pancake coils which is prepared by winding said superconductive wires having said first fine grooves in the form of a pancake.

BRIEF DESCRIPTION OF THE DRAWINGS

FIG. 8 is a diagram showing heat transfer characteristic;

FIGS. 9 and 10 show one embodiment of the present invention; and

FIGS. 11(*a*), (*b*), (*c*), (*d*) show sectional views of modifications of the fine channels.

DETAILED DESCRIPTION OF THE PREFERRED EMBODIMENTS

Figure 1:
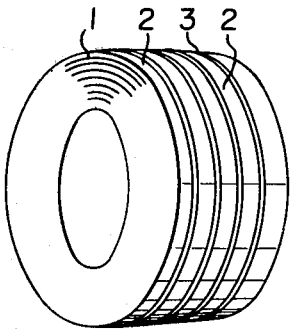
FIG. 1 is a schematic view of a conventional superconductive coil.
Figure 2:
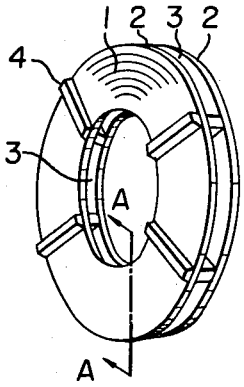
PRIOR ART FIG. 2
FIG. 2 is a schematic view of two plates of pancake coils.
Figure 3:
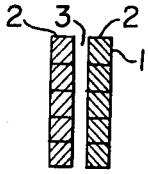
PRIOR ART FIG. 3
FIG. 3 is a partial sectional view of the pancake coils.
Figure 4:
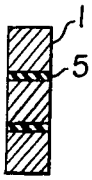
PRIOR ART FIG. 4
FIG. 4 is a partially enlarged sectional view of the pancake coils.
Figure 5:
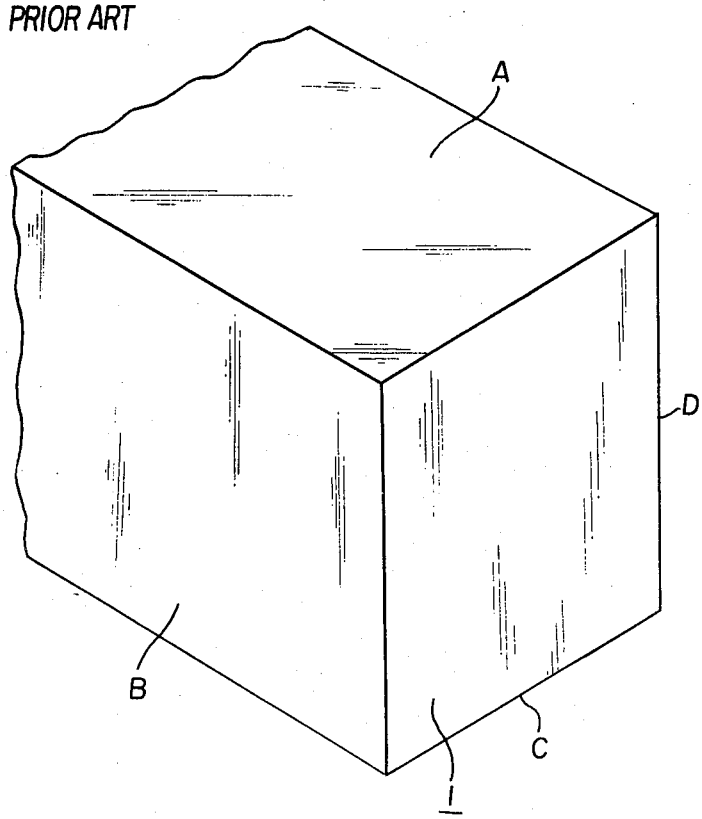
FIG. 5 PRIOR ART
FIG. 5 is an enlarged schematic view of a conventional superconductive wire.
Figure 6:
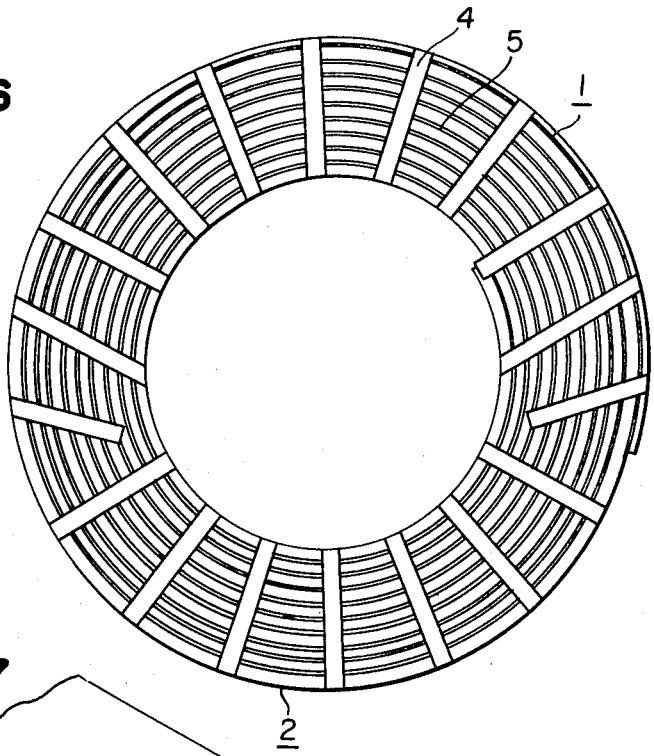
FIG. 6 PRIOR ART
FIG. 6 is a plane view of the conventional pancake coils.
Figure 7:
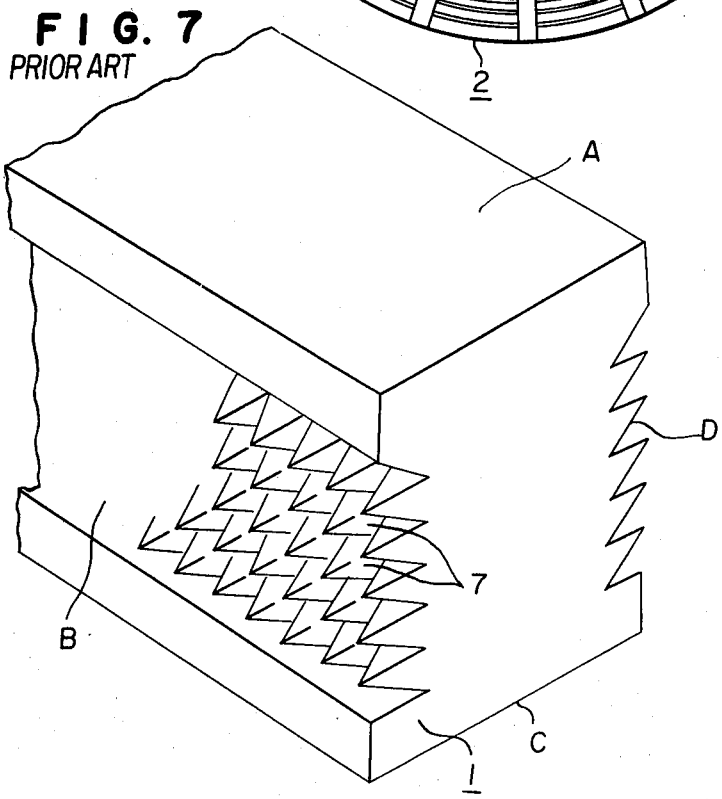
FIG. 7 PRIOR ART
FIG. 7 is an enlarged schematic view of a superconductive wires proposed in the prior art.

The superconductive wire having fine grooves on both sides in the longitudinal direction is, in accordance with the present invention, wound under the effect of inserting a fiber glass tape impregnated with an epoxy resin binder on a drum to prepare pancake coils. In the winding operation, reels and wound wire fixtures are used. The pancake coils fixed by the fixtures are cured in a curing chamber. The temperature and the time for the curing can be selected depending upon the epoxy resin binder.

The pancake coils are obtained by releasing the reels and fixtures.

Each of the pancake coils is set on a surface plate and fine grooves are formed by a knurling process on the fine grooves formed on the superconductive wire so as to cross or intersect each other in most of the positions except the tangential parts.

The pancake is then turned upside down and the same fine grooves are formed on the reverse surface by a knurling process on the fine grooves formed on the superconductive wire.

The existence of a shortcircuit between turns is tested to confirm that no shortcircuit is present. The pancake having first and second fine grooves in different direction is thus obtained. Many pancakes having the same structure are prepared and superposed each other and are fixed under pressure to obtain a superconductive coil.

Referring to the drawings, one embodiment of the present invention will be illustrated.

FIG. 9 shows the superconductive wire on which many grooves having a V shaped sectional view as the first fine grooves (71) are formed on the surface of the wire in the longitudinal direction of the wire by a cutting, knurling or drawing process in the preparation of the superconductive wire. The first fine grooves (71) have a pitch of 1.5 mm or less and a depth of 1.5 mm or more.

FIG. 10 shows the pancake coils (2) which are formed by winding the superconductive wires (1) with each insulator (5) between turns in the pancake and forming second fine grooves (72) having a pitch of 1.5 mm or less and a depth of 1.5 mm or more so as to intersect the fine grooves (71) in the wire direction formed in the preparation of the superconductive wire and placing interlayer spacers (4) at desired positions. As for the process for forming the second fine grooves (72) after winding the pancake coils, the cutting or knurling process are considered desirable.

The excellent heat transfer characteristic $Q_a(T_C-T_B)$ as found in the proposed prior art shown by the curve (a) in FIG. 8 is obtained on the cooling surface having the fine grooves (7). Thus, the superconductive coil prepared by plying a plurality of the pancake coils (2), passes a remarkably larger current than that of the conventional superconductive coil having smooth cooling surface whereby a large size superconductive coil having a large current density is obtained.

In the formation of the fine grooves which are mutually crossed or intersecting, one type of fine grooves is formed after winding the pancake coil thereby eliminating the problems caused by the preparation of the fine grooves in plural directions in the preparation of the long wire in the proposed prior art. Moreover, the complicated process for winding the superconductive wire having fine grooves in plural directions in the holding of the superconductive wire can be eliminated. Thus, remarkable improvement is expected in view of the construction of the superconductive coils.

In this embodiments, the sectional view of the fine grooves (7) formed for the improvement of the heat transfer characteristic is in the form of sharp saw tooth shown in FIG. 11(*a*). The same effect of the embodiment is attained by the fine grooves having the flat or curved edge parts (8) shown in FIG. 11(*b*), (*c*) or (*d*).

In the embodiment, the fine grooves (7) are formed in two directions. However, in the present invention, the fine grooves (7) can be formed in three or more directions.

As described above, in accordance with the present invention, one type of fine grooves is formed after winding the superconductive wire having another type of fine grooves in the form of pancake coils in the formation of the crossed fine grooves on the cooling surfaces of the pancake coils. Thus, the superconductive coil having high quality in view of characteristics and construction can be obtained. The practical advantages are remarkable.

What is claimed as new and desired to be secured by Letters Patent of the United States is:

1. A superconductive coil comprising a plurality of pancake coils made of superconductive wires and having at least one cooling surface on which first and second fine grooves are respectively formed in different directions wherein said first fine grooves are formed along the surface of said wires along the longitudinal direction of said wires in preparing said superconductive wires and said second fine grooves are formed on the surface said pancake coils so as to intersect said first fine grooves.

2. The superconductive coil according to claim 1 wherein said first and second fine grooves each have a pitch of 1.5 mm or less.

3. The superconductive coil according to claim 1 or 2 wherein the depth of each of said first and second fine grooves is the same or greater than the pitch of said first and second grooves, respectively.

* * * * *